US005607521A

United States Patent [19]

Bech-Nielsen et al.

[11] Patent Number: 5,607,521

[45] Date of Patent: Mar. 4, 1997

[54] METHOD FOR POST-TREATMENT OF AN ARTICLE WITH A METALLIC SURFACE AS WELL AS A TREATMENT SOLUTION TO BE USED IN THE METHOD

[75] Inventors: Gregers Bech-Nielsen, Birkerød; Peter T. Tang, Copenhagen, both of Denmark

[73] Assignee: IPU Instituttet for Produktudvikling, Lyngby, Denmark

[21] Appl. No.: 244,137

[22] PCT Filed: Nov. 10, 1992

[86] PCT No.: PCT/DK92/00328

§ 371 Date: May 13, 1994

§ 102(e) Date: May 13, 1994

[87] PCT Pub. No.: WO93/10278

PCT Pub. Date: May 27, 1993

[30] Foreign Application Priority Data

Nov. 15, 1991 [DK] Denmark ..... 1873/91

[51] Int. Cl.[6] ..... C23C 22/42

[52] U.S. Cl. ..... 148/261; 148/273

[58] Field of Search ..... 148/261, 273

[56] References Cited

U.S. PATENT DOCUMENTS

| | | | |
|---|---|---|---|
| 2,839,439 | 6/1958 | Stapleton | 148/261 |
| 4,264,378 | 4/1981 | Oppen | 148/261 |

FOREIGN PATENT DOCUMENTS

| | | | |
|---|---|---|---|
| 0045017 | 2/1982 | European Pat. Off. . | |
| 1297630 | 6/1969 | Germany | 148/261 |
| 3443928 | 6/1986 | Germany . | |
| 1041347 | 9/1966 | United Kingdom . | |
| 2070073 | 9/1981 | United Kingdom . | |

OTHER PUBLICATIONS

Patent Abstracts of Japan, vol. 12, No. 344, C–528, abstract of JP, A, 63–100194 (Kawasaki Steel Corp.), 2 May 1988.

Dialog Information Services, File 351, World Patent Index 81–92, Dialog accession no. 009011675, WPI accession no. 92–139008/17.

Von U. Büttner et al; "Suche nach Chromatierungsalternativen", *Galvanotechnik*, pp. 1589–1596 (1989).

*Primary Examiner*—Sam Silverberg

*Attorney, Agent, or Firm*—Scully, Scott, Murphy & Presser

[57] ABSTRACT

A method and a treatment solution for posttreatment of an article with a metallic surface, where the metallic surface is made of one or more metals of a standard oxidation potential within the range −2.5 to +0.5 V. A thin coating is formed on the metallic surface by a treatment with an aqueous solution containing a molybdenum compound selected among molybdic acid and salts thereof in a concentration of 2.9 to 9.8 g/l calculated as molybdenum, as well as a compound capable of forming a heteropolymolydate, such as phosphoric acid, together with a molybdate. The treatment is performed under conditions where the metal surface is maintained at a potential within the range of −600 and −1800 mV/nhe. A corrosion-protecting and/or decorative effect is obtained which can be compared with the effect obtained by conventional chromate treatment, and which avoids the environmental and toxicologic drawbacks associated with the chromate treatment.

11 Claims, No Drawings

METHOD FOR POST-TREATMENT OF AN ARTICLE WITH A METALLIC SURFACE AS WELL AS A TREATMENT SOLUTION TO BE USED IN THE METHOD

TECHNICAL FIELD

The present invention relates to a method for posttreatment of an article with a metallic surface, where the metallic surface is made of one or more metals having standard oxidation potentials within the range −2.5 to +0.5 V, and where the metallic surface is subjected to a treatment by means of an aqueous treatment solution in order to form a thin coating, said treatment solution containing a) a molybdenum compound selected among molybdic acid and salts thereof, and b) a compound capable of forming a heteropolymolybdate together with a molydate, as well as to a treatment solution to be used in the method.

BACKGROUND ART

It is a known procedure to aftertreat metal articles and metal surfaces with chromate in order to obtain a surface coating having corrosion-protecting and/or decorative properties. The treatment is called a chromate treatment and is known for instance in connection with zinc-coated, cadmium-coated or silver-coated copper or iron, including steel. Conventionally, aluminium and aluminium alloys are also treated by a chromate treatment.

The protective effect of a chromate treatment is due to a chemical conversion of a thin metallic surface layer of zinc, cadmium, silver or aluminium by reaction with chromic acid or chromates to form chromium hydroxide/chromate, The resulting layers have also been found useful in treating metal surfaces which are corrosion-resistant per se as such layers are distinguished by being very thin and can be used for achieving a particularly decorative effect.

Although the chromate treatment has the advantages of excellent anticorrosive and decorative properties, and although the method is simple and inexpensive, the use of chromate is restricted by the regulations applying to environmental pollution, and chromate causes problems, such as toxicity to the workers exposed to chromate during the treating process, and difficult disposal of the chromate sludge after the precipitation from the spent solution. In addition, a possibility exists of chromate being released from the chromate-treated products.

Büttner, Jostan and Ostwald, Galvanotechnik 80 (1989) No. 5, pages 1589–1596, have tested various methods for their applicability as replacements of the chromate treatment. Among these possible methods, Büttner et al mention formation of layers containing molybdenum and tungsten by treatment with molybdenum and tungsteniso- or heteropolyacids or salts thereof in connection with zinc-coated surfaces. The isopolyacids form polymeric anions with the same metal atom, such as $HW_6O_{21}^{5-}$. The heteropolyacids are formed from the isopolyacids with mineral acids and provide mixed anions, such as $P(W_{12}O_{40})^{3-}$. Molybdic acid $H_2MoO_4$, ammonium heptamolybdate $(NH_4)_7Mo_6O_{24}.4H_2O$, molybdatophosphoric acid $H_3[P(Mo_3O_{10})_4].XH_2O$, ammonium paratungstate $(NH_4)_{10}H_2W_{12}O_{42}.XH_2O$, phosphotungstic acid $H_3[P(W_3O_{10})_4].XH_2O$, and silicotungstic acid $H_4[Si(W_3O_{10})_4].XH_2O$ are examples of such compounds which according to Büttner et al. can form molybdenum-containing or tungsten-containing layers on zinc coatings. The layers are precipitated from 2% solutions at room temperature and in some cases with addition of small amounts of acid, base or oxidation agents, such as hydrogen peroxide or sodium perborate. In connection with phosphomolybdic acid, a 2% solution contains approximately 12 g/l of molybdenum and approximately 0.3 g/l of phorphorus corresponding to a molar ratio Mo/P of 12.9. The tests performed by Büttner et al. demonstrate that the materials in question provide a certain passivating effect, but the protecting effect thereof cannot compete with the effect of conventional chromate treatment.

GB-PS No. 1,041,347 discloses a process and a treatment solution for corrosion-protection of metal surfaces, where for instance Example 2 of This publication describes the treatment of steel or zinc- or cadmium-coated steel. This Example uses a first treatment solution containing 0.5 to 2.5% by weight of anionic polymer in form of polyvinyl toluene sulfonic acid of a molar weight of for instance 400,000, 0.1 to 0.5% by weight of zinc carbonate, 0.1 to 0.5% by weight of ammonium molybdate corresponding to from 0.49 to 2.44 g/l Mo, 0 to 0.2% by weight of phytic acid, and 0to 0.5% by weight of orthophosphoric acid, and with a pH-value within the range 5.0 to 6.8, and where the temperature of the treatment solution is maintained at about 125° F. which corresponds to 51° C. A typical treatment solution contains 0.25% by weight of ammonium molybdate and 0.2% by weight of orthophosphoric acid, which corresponds to a molar ratio Mo/P of 2.58. However, the known treatment solution is not used alone as the metal surface is to be treated subsequently with a second treatment solution containing an organic cationic substance reacting with the artionic polymer. Accordingly, the treating process is rather complicated.

GB Patent Application No. 2,070,073 (Kobe Steel Ltd.) discloses an anticorrosive treatment for preventing white rust on galvanised steel, where a solution is applied onto the surface of the galvanised steel. This solution contains molybdic acid or a molybdate in a concentration of 10 to 200 g/l calculated as molybdenum and is adjusted to a pH-value of between 1 and 6 by the addition of an organic or inorganic acid, preferably phosphoric acid.

By proceeding on the basis of the disclosure of the above GB Patent Application No. 2,070,073, it is, however, not possible to obtain a completely satisfactory protection against white rust. It appears thus from the following comparison Examples B and C, that this method results in a substantially poorer protection against corrosion than the protection obtained by the conventional chromate treatment.

EP-A-004501 (Nippon Kinzoka Co. Ltd.) discloses an anticorrosive treatment of stainless steel sheets having a Bright Annealing film or a passive film; the sheet is dipped in a solution containing 0. 1 to 70% by weight of phosphoric acid, 0.1 to 10.0% by weight of a molybdate or chromate or a mixture thereof and 0.1 to 0.2% of magnesium oxide, sodium silicate or mixture thereof; and cathodic treatment is carried out under the conditions of 1 to 600 $As/dm^2$ integrated electric current density and 0° to 90° C. temperature.

The ranges for the amounts of phosphoric acid and molybdate are rather broad, but only exemplified with 9.37% by weight and 1.34% by weight, respectively in Example 3 giving a molar ratio Mo/P of 0.068 and 10% by weight and 0.5% by weight, respectively, in Example 8 giving a molar ratio Mo/P being even lower.

It is clearly stated and confirmed by experiment that a film (BA or passive) must be formed before the treatment, otherwise there may be no improvement in corrosion resistance (p, 4, lines 11 to 29).

It turned out surprisingly, that it is possible to obtain a corrosion-protecting and decorative coating, which can compete with the .coating obtained by the conventional chromate treatment by means of a treatment solution containing a molybdenum compound (a) and a compound (b) capable of forming a heteropolymolybdate together with molybdate, where the molybdenum concentration and the ratio between the compounds (a) and (b) differs from those suggested by Büttner et al. and from the GB Patent Application No, 2,070,073 and EP-A-O 045 017.

DESCRIPTION OF THE INVENTION

The present invention relates to a method for posttreatment of an article with a metallic surface, where the metallic surface is made of one or more metals of a standard oxidation potential within the range −2.5 to +0.5 V, and where the metallic surface is subjected to a treatment by means of an aqueous treatment solution in order to form a thin coating, said treatment solution containing a) a among molybdic acid and salts thereof, and b) a compound capable of forming a heteropolymolybdate together with a molydate, said method being characterised by using as a treatment solution a solution essentially consisting of a) 2.9 to 9.8 or 11.5 g/l preferably 4.0 to 5.0 g/l or 9.0 to 9.7 g/l, molybdenum compound calculated as molybdenum, b) a compound (b) selected among phosphoric acid, titanic acid, zirconic acid, silicic acid, and an indium salt, in an amount resulting in a molar ratio Mo/P of 0.2 to 0.8 when the compound (b) is phosphoric acid, and C) an aquous solvent, and by maintaining the metallic surface at a potential of −600 to −1800 mV/nhe.

The best results so far have been obtained by means of a concentration of 4.8 g/l calculated as molybdenum. Good results have also been obtained with a concentration of 9.6 g/l.

The method according to the invention turned out to allow formation of a thin coating on metal surfaces. As far as the corrosion protection is concerned, this coating proves equal to the coatings obtained by conventional chromate treatment, but without the inherent toxicological and environmental problems of said conventional chromate treatment.

The method allows achievement of coatings of a layer thickness in the range 0.05 μm to 1 μm. These layer thicknesses are of the same magnitude as the layer thicknesses obtained by way of chromate treatment, and thus provide a corresponding decorative colour effect. The colour effect depends on the layer thickness and appears as interference colours from red to yellow and then blue, where for instance a layer thickness of 0.1/ μm corresponds to yellow, and where a layer thickness up to 1 μm goes from brown to black.

The solutions used according to the invention have a concentration of the molybdenum compound which is clearly below the concentrations previously suggested by both Büttner et al and the GB Patent Application No. 2,070,073. Such a change of the concentration turned out surprisingly to act on the efficiency of the treatment so that a noticable, but far from satisfactory effect by the previously known methods was changed to a corrosion-protecting effect fully competitive with the effect obtained by the conventional chromate treatment.

Beyond the obvious advantage obtained by the possibility of replacing the, technically speaking, efficient chromate treatment, which as previously mentioned is undesired due to the environmental and toxicological risk, a further advantage is obtained because it is furthermore possible to use treatment solutions with low concentrations of the active compounds. Such low concentration solutions are less complicated to use with respect to production and maintenance. As far as rinsing of the treated articles and purification of the waste fluid from the used baths are concerned, the work involved therewith is also less complicated when low concentration treatment solutions are used.

In principle any compound capable of forming a heteropolymolybdate together with molybdate can be used as the compound b). Advantageous examples of such compounds are mineral acids, such as phosphoric acid, titanic acid, zirconic acid, and silicic acid, as well as indium salts.

Particularly good results are obtained by the method according to the invention when the pH-value of the treatment solution exceeds 1, preferably 1.8, but no more than 5.0. Particularly advantageous results are obtained with a pH-value either in the range 1.9 to 2.9, such as approximately 2.0, or alternatively 3.8 to 4.8, such as about 4.6.

The embodiment using phosphoric acid as the compound b) turned out to provide particularly good results when the content of the solution of molybdenum compound and phosphoric acid results in a molar ratio Mo/P of at least 0.2, particularly preferred at least 0.3, and max. 0.8, preferably no more than 0.7, and particularly preferred within one of the ranges 0.3 to 0.4 or 0.6 to 0.7. Up till now the best results have been obtained with a molar ratio Mo/P of 0.33.

When the compound b) is phosphoric acid, the phosphoric acid serves furthermore to set the desired pH-value of the treatment solution. When the compound b)is titanic acid, zirconic acid, silicic acid or an indium salt, these acids or the salt cannot be used for setting the pH-value, and usually it is therefore necessary to add a mineral acid, such as sulphuric acid.

Surfaces made of zinc, aluminium, nickel, iron, magnesium, tin, cobalt, and copper, as well as alloys thereof, such as brass, various types of stainless steel and cobalt/zinc alloys are examples of metal surfaces which are advantageously treated by the method according to the invention.

A particularly advantageous range of the potential for the metal surface used by the method according to the invention is found between −800 and −1000 mV/nhe. When the metal surface is made of zinc, the above potential can be obtained without requiring an action from the outside because the immersing of an article with 5 zinc surface in the treatment solution causes the potential to automatically set within the above range. According to a particularly advantageous embodiment of the method according to the invention involving zinc surfaces, it is thus possible to carry out said method without acting on the potential from the outside by way of immersing said surfaces into the treatment solution. In the latter case, a treatment solution is used which contains a molybdenum compound and phosphoric acid in quantities resulting in a molar ratio Mo/P of 0.2 to 0.8 While the treatment solution is kept at a temperature in the range of 45° to 80° C., and where said treatment is performed during a period of from 30 sec. to 500 sec.

The invention relates furthermore to a treatment solution containing a) a molybdenum compound selected among molybdic acid and salts thereof and b) a compound capable of forming a heteropolymolybdate together with a molydate to be used by the method according to the invention, said treatment solution being characterised by essentially consisting of.

a) 2.9 to 11.5 g/l molybdenum compound calculated as molybdenum, b) a compound (b) selected among phosphoric acid, titanic acid, zirconic acid, silicic acid, and an indium salt, in an amount resulting in a molar ratio Mo/P of 0.2 to 0.8 when the compound (b) is phosphoric acid, and c) an aquous solvent.

The scope of the applicability of the invention appears from the following detailed description. Having generally described the invention, a more complete understanding can be obtained by reference to the indicated specific Examples, which are provided herein for purposes of illustration only and are not intended to be limiting as various changes and modifications within the scope of the invention are obvious to persons skilled in the art on the basis of this detailed description.

DETAILED DESCRIPTION OF THE INVENTION

As mentioned, a thin coating having corrosion-protecting and decorative properties is obtained by the method according to the invention, said properties being fully competitive with the properties of a conventional chromate coating:

The present invention was originally developed in connection with zinc-coated materials where outstanding results were obtained by immersion of the material into an aqueous solution containing phosphoric acid and a molybdenum compound. The concentration of the molybdenum compound was between 2.9 and 9.8 gl calculated as molybdenum. The standard oxidation potential of zinc is −760 mV, but by immersion of a material with a zinc surface into said coating solution, the potential of the zinc surface decreases to a value of between −800 and −1000 mV/nhe (where mV/nhe corresponds to the potential in mV relative to a standard hydrogen electrode). Under these circumstances, evolution of hydrogen is usually expected, but no signs of such hydrogen evolution have been observed, which supports the observation that a particular effect is obtained as a consequence of the molybdenum content of the aqueous treatment solution within the stated concentration limits. Analyses of the composition of the resulting surface layer by means of Auger- and ESCA-examinations have shown that molybdenum appears in an unusual form in the layers (apart from in the few outermost atomic layers), as said molybdenum appears with a lower oxidation state than in molybdate. When these examinations are compared with other measurements from the literature on molybdenum-containing layers, the comparison indicates that the method according to the invention provides quite outstanding reactions provided the concentration range of 2.9 to 9.8 g/l of molybdenum indicated according to the invention is not exceeded. The Auger analysis and the ESCA analysis are both X-ray analyses suitable for determining the composition (in % by atom of the elements present) of the few outermost atomic-layers on a solid surface. Subsequently, it is possible to remove a few layers, analyse, remove more layers, and analyse again so as finally to achieve a profile describing the content in % of all the elements present in even very thin layers. Finally the analysis shows that the metal coated with the surface layer has been reached. These analyses have been described in greater detail in the textbook: D. Briggs & M. P. Seah (ed.): "Practical Surface Analysis", 2nd Ed., Wiley, N.Y., 1990.

Later on, it turned out that the method can also be used for replacement of chromate treatment of other metallic surfaces provided a potential is applied from the outside so as to provide the metallic surface with a potential within the same range as the potential appearing where no current is applied from the outside by immersion of an article with a zinc surface into the aqueous solution of molybdenum compound and phosphoric compound, viz. said potential of −800 and −1000 mV/nhe. Such results have for instance been observed in connection with the metals aluminium, nickel, and steel, including both plain steel and stainless steel. These metals are very different from zinc, and the immersion alone of these metals into the indicated treatment solution results in a potential outside the indicated range whereby accordingly no effect is obtained. However, if a potential within said range is forced on one of these metals, i.e. an article with a surface of said metal is allowed to act as cathode at the same time as for instance an anode of stainless steel or another suitable metal is used in a cell with the aqueous treatment solution as cell fluid, a thin surface layer is formed on the metallic surface of the same type as the coating obtained on an article with a zinc surface.

A treatment of nickel in the above manner turned out for instance to result in a layer with a particularly good protecting effect. Thus the corrosion rate was reduced to 1/10 of the corrosion rate in case of the untreated nickel surface.

In addition it turned out that it is possible in the above manner to control the colour appearing by formation of the protecting layer. As mentioned, producing colours on stainless steel by means of chromate-containing baths is a known technique, and it is also known that the coloured articles produced by the known method present an improved resistance to corrosion compared to untreated metal. The method according to the invention has now made it possible to obtain corresponding effects without the drawbacks associated with chromate treatment.

It turned out that when the metallic surface was maintained at the desired potential by applying a potential from the outside, the physical conditions for the treatment are less critical compared to the situation where a zinc surface is immersed into the treatment solution without the supply of current from the outside. In this manner it is possible to obtain a protection by means of a lower treatment temperature, such as at room temperature, where the temperature should ordinarily be kept in the range 45° to 80° C. in connection with treatment of a zinc surface without the application of a potential. In addition, it is possible to use other combinations than molybdenum compound and phosphoric acid as the phosphoric acid can be replaced by other compounds capable of forming a heteropolymolybdate together with molybdate. Thus the phosphoric acid can be replaced by titanic acid, zirconic acid, silicic acid or an indium salt. When titanic acid, zirconic acid, silicic acid or an indium salt is used, a considerably lower concentration thereof is usually used while a mineral acid, such as sulphuric acid, is simultaneously added in order to ensure the desired pH-value.

The appropriate potential range is also less critical as excellent results are obtained as long as the potential is kept between −600 and −1800 mV/nhe. An appropriate potential can be determined in practice as it results in only a very insignificant evolution of hydrogen. It should be underlined that the application of a potential from the outside renders it possible also to treat zinc surfaces with a good result under the above less critical conditions.

The first results of the method according to the invention are described in relation to the matter now considered a particular embodiment, viz. the case where the metallic surface is made of zinc or a zinc alloy, and where the treatment is performed without the application of a potential from the outside for providing the desired potential. This embodiment is referred to below as "the electroless embodiment".

The electroless embodiment of the method according to the invention is particularly suited for conventional protection against corrosion of zinc coatings, such as in connection with galvanisation, especially electroplated zinc, but optionally also in connection with hot dip zinc or another manner known per se.

Corrosion protection of zinc coatings is widely used in connection with corrosion protection of materials mass-produced at low costs, especially small items, such as screws, bolts, fittings, washers etc. made of steel.

The electroless embodiment can be used for posttreatment of a layer of pure zinc as an alternative to the conventional chromate treatment, but it can also be used for a layer of zinc alloyed with nickel, cobalt or iron, where the chromate treatment is difficult or often even of doubtful value. The treatment can furthermore be used on a composite material produced by the Japanese company Nihon Parkerizing Co. under the name SBC-plating which is a material with zinc as main ingredient and with particles embedded therein, said particles including oxides, such as in particular aluminium oxide and chromium(III)oxide. Such a composite material cannot be subjected to a chromate treatment. The SBC-plating forms the above oxides during the plating process. The electroless embodiment can also be used for posttreatment of zinc-containing coatings, where oxides have been added during the coating process from the outside under conditions causing the oxides to be embedded in the zinc coating.

The treatment according to the electroless embodiment is usually performed by way of a simple immersion of the zinc-coated steel article into the treatment solution. No particular restrictions apply, however, to the treating method in this respect. Alternative methods, such as spraying or rolling on of the treatment solution or other conventional methods can thus also be used.

After the treatment, the article is usually rinsed with distilled water. The succeeding drying is usually performed without involving heating and/or feeding of air.

The various parameters of the treatment are, as mentioned, critical for the electroless embodiment. Thus the compound b) must be phosphoric acid. In addition, the aqueous treatment solution should be used at a temperature of at least 45° C., preferably at least 50° C., and particularly preferred at least 55° C., and max. 80° C., preferably no more than 75° C., and particularly preferred no more than 65° C., and the treatment should be performed during a preferred period of at least 30 sec, preferably at least 60 sec, and particularly preferred at least 100 sec., and max. 500 sec, preferably max. 300 sec., and particularly preferred max. 140 sec. The best results have been obtained with a treating period of 120 sec.

The remaining embodiments involve supply of current from the outside in order to ensure a potential of between −600 and −1800 mV/nhe, and here the conditions are less critical, which also applies to the situation where the metallic surface is a zinc-containing surface with the only proviso that the potential is correspondingly controlled by the application of the necessary potential from the outside.

The treatment by the embodiments involving an applied potential is performed in the same manner as for the electroless embodiment, but whereby the necessary potential is additionally ensured by immersing in a manner known per se an anode, such as of stainless steel, into the treatment solution and apply the necessary potential in such a manner that the metallic surface of the article being treated acts as a cathode with a potential of between −600 and −1800 mV/nhe.

The embodiments including an applied potential turned out advantageously to allow treatment of surfaces of aluminium, nickel, and various types of steel, such as stainless steel. As far as nickel is concerned good results have been observed both with electroplated nickel and with so-called chemical nickel, electroless nickel, i.e. chemically plated nickel layer.

The method can also be used for treating magnesium, which can also be treated traditionally by way of chromate treatment. Tests performed on magnesium have revealed a formation of colour which is characteristic of the thin heteropolymolybdate layers formed by the method according to the invention.

Additional examples are surfaces of copper and copper alloys, such as brass and bronze, where the surface of copper or copper alloy post-treated by the method is suited for use as priming layer for a subsequent lacquering.

The use of the embodiments with a controlled potential turned out to allow a control of the electrolysis conditions in such a manner that it is now possible to control the colouring of the resulting layer. In this manner an excellent combination of a controlled decorative effect at the same time as an improved protection against corrosion is obtained.

The treatment solution according to the invention is usually prepared by initially dissolving the molybdenum compound to achieve a molybdate concentration of between 0.0302 and 0.102 mol/l corresponding to 2.9 and 9.8 g/l of molybdenum.

When the compound b) is phosphoric acid, said compound is subsequently added in order to achieve the desired molar ration Mo/P within the range of 0.2 to 0.8, the pH-value being set according to desire to a value of between 1 and 5, preferably between 1.8 and 5.

When the compound b) is phosphoric acid, the composition of the treatment solution differs substantially from the previously suggested treatment solutions with respect to the molar ratio of molybdenum to phosphor. Thus, the treatment solution suggested by Büttner et al. has approximately 12 g/l of molybdenum and approximately 0.3 g/l of phosphorus resulting in a molar ratio Mo/P of 12.9.

The pH-value of the solution can, as mentioned, vary between 1 and 5. It turned out, however, that particularly good results are obtained when the pH-value is kept within one of two separate ranges, viz, either the range 1.9 to 2.9 or the range 3.8 to 4.8. A poorer corrosion-protecting effect has thus been observed by the tests performed until today within the range between these particularly advantageous ranges.

EXAMPLE 1

An article of steel in the shape of a cylinder is coated with a zinc layer of 20 μm by way of conventional electrolytic zinc plating and is treated immediately thereafter in the following manner:

The article is pretreated by way of etching in 0.15M nitric acid for 10 sec. at room temperature followed by rinsing in distilled water.

Then the article is immersed into a solution containing 0.050 mol/l of sodium molybdate (4.8 g/l of molybdenum) and 0.150 mol/l of phosphoric acid (4.7 g/l of phosphorus), pH=2.0. The temperature of the solution is 60° C., and the article is treated in the solution for 2 min. while subjected to slight stirring. Then the article is rinsed in distilled water and voluntarily dried, i.e. left to dry without the use of a hot-air blower or the like. Such a treatment causes formation of a thin film with bright yellow shades. These shades indicate that the thickness of the resulting layer is of the magnitude 0.1 μm.

After 24 hours, a measurement of the corrosion is performed by way of the CMT-method in a 3% sodium chloride solution at a pH-value of 5.000±0.002. After 1 hour in the sodium chloride solution, a corrosion rate of 10 μA/cm$^2$ is measured. The CMT-method has been described in greater detail in Proceedings, SUR/FIN'91 Technical Conference, Toronto, June 1991, page 955.

COMPARISON EXAMPLE A

A zinc-coated cylinder is used as starting material, said cylinder being produced as stated in Example 1, but not subjected to a posttreatment. The corrosion rate of this cylinder is determined according to the CMT-method to be 120 μA/cm$^2$.

COMPARISON EXAMPLE B

A corresponding sample prepared by a chromate treatment and measured under the same conditions shows a corrosion rate in the range of 8 to 20 μA/cm$^2$.

COMPARISON EXAMPLE C

A zinc-coated sample is produced and pretreated with nitric acid as described in Example 1. Then the sample is subjected to a treatment as described in Example 1 of GB Patent Application No. 2,070,073 with an aqueous solution containing potassium molybdate in a concentration of 53 g/l calculated as molybdenum and set to a pH-value of 3 by addition of phosphoric acid.

The treatment was performed at a bath temperature of 20° C. by immersion of the zinc-coated sample for 2 to 3 sec., whereafter the excess liquid was removed by way of dabbing with flock-free filter paper. Then the sample was dried at 130° C. by means of a stream of hot air for about 30 sec.

A measurement of the corrosion according to the CMT-method revealed that after a stay of 25 min. in a 3% sodium chloride solution at a pH-value of 5.000±0.002, the corrosion rate of the sample exceeded a value of 20 μA/cm$^2$. After continued exposure, continuously increasing rates were observed.

Accordingly it appears that the treatment suggested in GB Patent Application No. 2,070,073 provides a considerably poorer protection against white rust than the treatment of a sample according to the invention as described in Example 1 and compared to the conventional chromate treatment.

EXAMPLE 2

A zinc-coated sample was produced in the same manner as in Example 1, and the sample was pretreated as in Example 1 by way of etching in 0.15M nitric acid for 10 sec. at room temperature followed by rinsing in distilled water.

Then the sample was treated by immersion for 2 min. while being subjected to a slight stirring in a 60° C. hot solution containing 0.100 mol/l of sodium molybdate (9.6 g/l of molybdenum) and 0.150 mol/l of phosphoric acid (4.7 g/l of phosphorus), pH 4.6. After rinsing in distilled water and a voluntary drying, the surface was coated with a slightly thicker film than the one obtained in Example 1, interference colours from red via yellow to blue being observed.

After 24 hours, a measurement of the corrosion was performed in a 3% sodium chloride solution at a pH-value of 5.000±0.002, and after 1 hour a corrosion rate of 20/TA/cm$^2$ was measured.

EXAMPLE 3

A steel cylinder was electrolytically plated with an alloy of zinc and nickel containing 15% by weight of nickel. The coating had of a thickness of 20 μm.

The plated cylinder was subjected to the same treatment as in Example 1, and after 1 hour a corrosion rate of 19 μA/cm$^2$ was determined according to the CMT-method.

EXAMPLE 4

A steel cylinder with an electroless nickel layer was connected as a cathode with an anode of stainless steel (alternatively a platinum anode can be used), and a voltage in the range of 2.5 to 3.0 V was applied between the anode and the cathode.

The cathode and the anode were immersed into a solution containing 0.050 mol/l of sodium molybdate (4.8 g/l of molybdenum), and 0.150 mol/l of phosphoric acid (4.7 g/l of phosphorus), pH 2.0. The solution had a temperature of 30° to 40° C., and the treatment was performed over a period of 30 to 50 sec.

This treatment resulted in a layer with a red-green colour corresponding to a layer thickness of 0.2 to 1.0 μm.

After 1 hour, a corrosion rate of 1 to 3 μA/cm$^2$ was determined according to the CMT-method, which corresponds to an improvement of 10 to 20 times compared to an untreated surface of electroless nickel.

EXAMPLE 5

A steel cylinder plated with electroless nickel was connected with an anode in the same manner as in Example 4, and a voltage in the range of 2.5 to 3.0 V was applied.

The cathode and the anode were immersed in a solution containing 0.12 mol/l of sodium molybdate and 0.01 mol/l of titanic acid, pH 2.5. The solution had a temperature of 30° to 40° C. and the treatment was performed over a period of 30 to 50 sec.

After 1 hour, a corrosion rate of 1 to 3 μA/cm$^2$ was determined according to the CMT-method, which corresponds to an improvement of 10 to 20 times compared to an untreated surface of electroless nickel.

EXAMPLE 6

A steel cylinder plated with electroless nickel was connected with an anode in the same manner as in Example 4, and a voltage in the range of 2.5 to 3.0 V was applied.

The cathode and the anode were immersed in a 30° to 40° C. solution containing 0.12 mol/l of sodium molybdate and 0.01 mol/l of zirconic acid, pH 3.5. The treatment was performed over a period of 30 to 50 sec.

After 1 hour, a corrosion rate of 1 to 3 μA/cm$^2$ was determined according to the CMT-method, which corresponds to an improvement of 10 to 20 times compared to an untreated surface of electroless nickel.

EXAMPLE 7

Samples 7A, 7B, 7C, and 7D of stainless steel were connected as cathodes with anodes and a voltage in the range of 2.5 to 3.0 V was applied.

The cathode and the anode were immersed in a 30° to 40° C. treatment solution, and the treatment is performed over a period of 30 to 50 sec. The following treatment solutions were used:

Sample 7A: as in Example 4

Sample 7B: as in Example 5

Sample 7C: as in example 6

Sample 7D: a solution of 0.12 mol/l of sodium molybdate and 0.01 mol/l of silicic acid, pH=2.5.

All the samples 7A to 7D disclosed decorative layers with a good adherence.

EXAMPLE 8

Samples 8A, 8B, 8C, and 8D of aluminium were connected as cathodes with anodes and 2.5 to 3.0 V was applied.

The cathode and the anode were immersed in a 30° to 40° C. treatment solution, and the treatment was performed over a period of 30 to 50 sec. The following treatment solutions were used:

Sample 8A: as in Example 4

Sample 8B: as in Example 5

Sample 8C: as in example 6

Sample 8D: the same solution as sample 7D.

Coatings with good adherence and a beautiful, decorative effect were obtained.

EXAMPLE 9

The treatment of surfaces of zinc, nickel, stainless steel or aluminium follows the same procedure as described in the Examples 4 to 8, but by means of a treatment solution containing 0.12 mol/l of sodium molybdate 0.01 mol/l of indium sulphate pH is adjusted to 2.5 to 3.0 with sulphuric acid.

In view of the above description of the invention it is obvious that the invention can be varied in many ways. Such variations are not to be considered deviations from the scope of the invention, and all such modifications obvious to persons skilled in the art are to be considered comprised by the following claims.

We claim:

1. A method for the posttreatment of an article having a metallic surface comprising contacting said metallic surface in an aqueous solution, said aqueous solution containing (a) a molybdenum compound selected from the group consisting of molybdic acid and a salt of molybdic acid, and (b) phosphoric acid, with the proviso that said molybdenum compound is present in a concentration of between 2.9 and 9.8 g/l solution, calculated as molybdenum, and that the phosphoric acid is present in an amount resulting in a molar ratio Mo/P of 0.3–0.4 or 0.6–0.7 thereby forming a heteropolymolydate compound at a pH of between 1 and 5 said metallic surface comprised of a metal having a standard oxidation potential within the range of −2.5 to +0.5 V, said metal further selected from those wherefrom a potential of −800 mV/nhe to −1000 mV/nhe is obtained by said contacting with said aqueous solution.

2. The method according to claim 1 wherein said molybdenum compound is present in a concentration of between 4.0 and 5.0 g/l, calculated as molybdenum.

3. The method according to claim 1 wherein said molybdenum compound is present in a concentration of between 9.0 and 9.7 g/l, calculated as molybdenum.

4. The method according to claim 1 wherein the pH of the solution is within the range of between 1.8 to 5.

5. The method according to claim 4 wherein the pH of the solution is between 1.9 and 2.9.

6. The method according to claim 4 wherein the pH of the solution is between 3.8 to 4.8.

7. The method according to claim 1 wherein said metal is selected from the group consisting of zinc, magnesium, and alloys thereof.

8. The method according to claim 1 wherein said aqueous solution has a temperature between 45° to 80° C. and the posttreatment is performed for a period of between 30 to 500 seconds.

9. A treatment solution useful for the posttreatment of an article having a metallic surface comprising an aqueous solvent containing a molybdenum compound selected from the group consisting of molybdic acid and a salt of molybdic acid, and phosphoric acid, with the proviso that said molybdenum compound is present in a concentration of between 2.9 and 9.8 g/l of solution, calculated as molybdenum, and that the phosphoric acid is present in an amount resulting in a molar ratio Mo/P of 0.3–0.4 or 0.6–0.7 thereby forming a heteropolymolydate compound at a pH of between 1 and 5.

10. The treatment solution according to claim 9 wherein said molybdenum compound is present in a concentration of between 4.0 and 5 0 g/l, calculated as molybdenum.

11. The treatment solution according to claim 9 wherein said molybdenum compound is present in a concentration of between 9.0 and 9.7 g/l, calculated as molybdenum.

* * * * *

UNITED STATES PATENT AND TRADEMARK OFFICE

CERTIFICATE OF CORRECTION

PATENT NO. : 5,607,521

DATED : March 4, 1997

INVENTOR(S) : Gregers Bech-Nielsen, et al.

It is certified that error appears in the above-identified patent and that said Letters Patent is hereby corrected as shown below:

Column 1, line 53: "molybdenum" should read -- molybdenum- --
Column 2, line 13: "This" should read --this---
Column 2, line 21: "0to" should read --0 to--
Column 2, line 31: "artionic" should read --anionic-
Column 3, line 5: delete "(a)" and "(b)"
Column 3, lines 7-8: "and the ratio between the compounds (a) and (b) differs from those suggested" should read --differs from the concentrations suggested--
Column 3, line 10: delete --and EP-A-O-045 017--
Column 3, line 20: "a among" should read --among--
Column 3, line 32: "C)" should read --(c)--
Column 3, line 52: delete -- / --
Column 4, line 31: "b)is" should read --b) is--
Column 5, line 40: "Analyses of the..." should begin a new paragraph.
Column 5, line 53: after "atomic" delete -- - --
Column 10, line 3: "20/TA/" should read --20 A/ --
Column 12, line 47, Claim 10: "5 0" should read --5.0--

Signed and Sealed this

Twenty-sixth Day of May, 1998

*Attest:*

Bruce Lehman

BRUCE LEHMAN

*Attesting Officer*

*Commissioner of Patents and Trademarks*